United States Patent [19]

Johnson

[11] Patent Number: 4,867,447

[45] Date of Patent: Sep. 19, 1989

[54] SYSTEM FOR DETERMINING PERFORMANCE ON AN EXERCISE ROWING MACHINE

[75] Inventor: Jeffrey B. Johnson, Bellevue, Wash.

[73] Assignee: Avita Health and Fitness Products Inc., Redmond, Wash.

[21] Appl. No.: 270,405

[22] Filed: Nov. 7, 1988

Related U.S. Application Data

[63] Continuation of Ser. No. 917,334, Oct. 9, 1986, abandoned.

[51] Int. Cl.[4] ..... A63B 69/06; A63B 21/24

[52] U.S. Cl. ..... 272/72; 272/129; 272/DIG. 5; 272/DIG. 6

[58] Field of Search ..... 272/72, 69, 73, 129, 272/130, 132, 93, DIG. 5, DIG. 6; 128/25 R; 73/379

[56] References Cited

U.S. PATENT DOCUMENTS

| | | | |
|---|---|---|---|
| 1,679,631 | 8/1928 | Seagraves | 272/72 |
| 3,266,801 | 8/1966 | Johnson | 272/72 |
| 3,848,467 | 11/1974 | Flavell | 272/DIG. 6 |
| 4,576,377 | 3/1986 | Wolff | 272/130 |
| 4,601,468 | 7/1986 | Bond et al. | 272/DIG. 6 |
| 4,627,610 | 12/1986 | Ishida et al. | 272/72 |
| 4,674,741 | 6/1987 | Pasierb, Jr. et al. | 272/72 |

FOREIGN PATENT DOCUMENTS

| | | | |
|---|---|---|---|
| 1083705 | 9/1967 | United Kingdom | 272/72 |

*Primary Examiner*—S. R. Crow

*Attorney, Agent, or Firm*—Seed and Berry

[57] ABSTRACT

An exercise rowing machine has swing-mounted rowing arms with chopper plates at their lower ends which have a series of light-passing ports arranged along an arc to swing through the gaps between the emitters and receivers of a pair of side-by-side light emitter/receiver units. A circuit containing these units is connected to a microprocessor programmed for outputs, such as length and duration of rowing arm strokes, using inputs from the emitter/receiver units.

7 Claims, 2 Drawing Sheets

SYSTEM FOR DETERMINING PERFORMANCE ON AN EXERCISE ROWING MACHINE

This application is a continuation of U.S. patent application Ser. No. 917,334, filed Oct. 9, 1986, now abandoned under C.F.R. § 1.62. Description

1. Technical Field

The present invention relates to exercise rowing machines in which it is desired to have readouts requiring automatic inputs of rowing arm stroke length and stroke speed to evaluate exercise performance.

2. Background Art

Exercise rowing machines commonly employ hydraulic cylinder assemblies with double-acting pistons for resisting load applied to pivoted rowing arms. The piston rods from the double-acting pistons are typically pivotally connected to the rowing arms and the cylinder components of the cylinder assemblies are typically pivotally connected to front frame members. To vary the leverage exerted by the rowing arms to change the resistance to swinging of the arms, it has been common to have the pivot for the piston adjustable along the rowing arms. In such an instance, the approach for determination of the rowing arm stroke has been to measure the maximum length of piston rod exposed during each rowing arm stroke.

DISCLOSURE OF THE INVENTION

An improved load-resisting hydraulic cylinder assembly has been developed in which the load resistance can be varied without changing the pivot point of the piston rods on the rowing arms. The present invention provides an improved arrangement enabling automatic monitoring of the length and speed of each rowing arm stroke and is particularly adapted for use on an exercise rowing machine equipped with such improved hydraulic cylinder assemblies. In carrying out the invention, there is provided a chopper plate at the lower end of each rowing arm which has a series of light ports arranged in an arc which passes between complementing light emitters and receivers arranged in a circuit for a microprocessor on the rowing machine programmed to calculate the stroke length and speed and maintain a stroke count responsive to the number of interruptions of light emission encountered during each swing of the chopper plates on the swing arms. The stroke reversal is determined by the use of a pair of the emitter/receiver units for each rowing arm spaced apart along the swing arc of the light ports in the chopper plate.

BEST MODE FOR CARRYING OUT THE INVENTION

Figure 1:
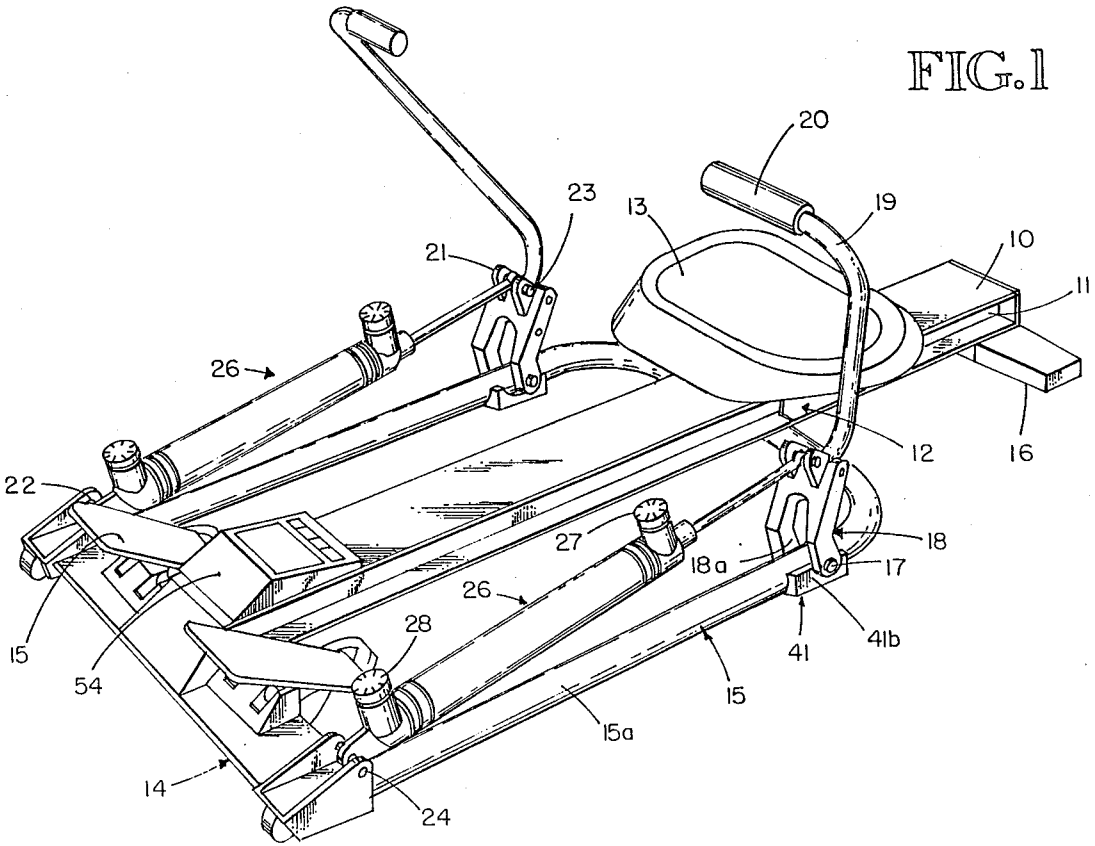
FIG. 1 is a perspective view of a rowing machine employing the present invention.

Referring to FIG. 1, the invention is illustrated applied to an exercise rowing machine of the type having a longitudinal center rail 10 with side tracks 11 for sets of rollers presented by a seat carriage 12 having a seat

13 in an arrangement such as shown in U.S. Patent No. 4,541,627. The center rail 10 is secured at its forward end to a front cross-member 14 on which a pair of foot plates 15 are pivotally mounted for vertical swinging movement. At its ends, the front cross-member 14 is connected to the legs 15*a* of a U-shaped tubular frame member 15 which is connected at its center to the underside of the center rail 10. A rear cross-member 16 supports the rear of the center rail 10 and, together with the center rail, front cross-member 14, and U-shaped member 15, make up the frame of the machine.

Pivotally mounted by pin 17 on the U-shaped member 15 are a pair of fork units 18 which are secured to the lower ends of a pair of rowing arms 19 provided with hand grips 20. Each fork unit 18 has a pair of clevis ears 21 which are complemented by a pair of clevis ears 22 at the respective end of the front cross-member 14. Pivotally mounted by pins 23, 24 between the pairs of clevis ears 21 and 22 are a pair of adjustable hydraulic load-resisting units 26 having an adjustable resistance to flow from each side of a double-acting piston therein which is varied by turning knobs 27, 28. Such hydraulic cylinder units 26 are like those disclosed in pending application Ser. No. 917,163; filed Oct. 9, 1986.

Figure 2:
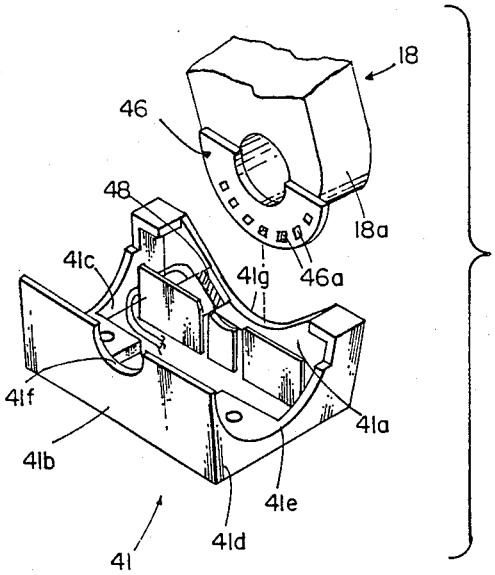
FIG. 2 is an exploded detail view taken at the lower end of one of the rowing arms.
Figure 3:
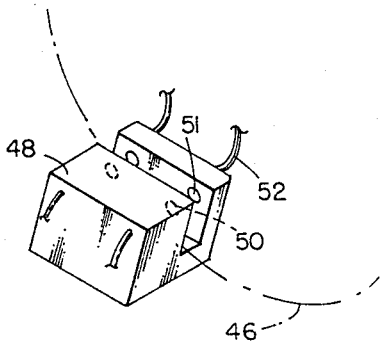
FIG. 3 is a perspective view of an emitter/receiver channel unit providing two sets of light emitters and receivers separated by a gap and with the swing path of the chopper through the gap being indicated by a broken arcuate line.

Directing attention to FIG. 2, mounted beneath each tubular leg 15*a* is a foot housing 41 having inner and outer side walls 41*a*, 41*b* and front and back end walls 41*c*, 41*d*. These end walls have semicircular cutouts 41*e* to interfit with one of the tubular legs 15*a*, and the outer side wall 41*b* has a semicircular cutout 41*f* for passage of pivot pin 17. The inner side wall 41*a* has a relatively large curved cutout 41*g* to accommodate the rounded free end of the inner fork 18*a* of the respective rowing arm fork unit 18. This inner fork 18*a* has connected to the outer side thereof a semicircular chopper plate 46 having a series of light ports 46*a* adjacent the curved edge thereof. These light ports 146*a* are arranged along an arc having the pivot axis of the pivot pin 17 as a center. The curved peripheral end portion of the chopper plate 46 containing the light ports 46*a* is arranged to pass through a channel unit 48 having a pair of light emitters 50 on one side of the channel and a pair of opposing receivers 51 on the other side of the channel. Wires 52 to these emitters and receivers pass from the foot housings 44 into the U-frame 15 and along the U-frame to central registering openings in the U-frame and central rail 10. Then the wires extend forwardly within the center rail to an upper opening beneath a readout housing 54 mounted on the upper wall of the central rail 10 at the front thereof. This housing contains a suitable microprocessor preferably programmed to calculate (a) the speed at which the light rays from the emitters 50 are chopped by the portions of the chopper plate 46 between the light ports 46*a* as the chopper plate swings back and forth responsive to stroking action applied to the arms 28*a* by the exercising person; (b) the number of light ports 46*a* passing the emitters during each stroke to determine the length of each stroke; (c) the direction of the stroke (forward and rearward); and (d) the total number of strokes during the exercise period. The microprocessor is also preferably programmed to receive inputs of the pressure settings on the ends of the hydraulic cylinder assemblies 26 and calculate the total calories expended from the start of the exercise period, and to calculate the force exerted by the exerciser during each stroke. The results of the calculations are preferably displayed at the face of the readout housing 54.

I claim:

1. An exercise rowing machine comprising:

a center longitudinal rail;

a support frame extending beneath said rail;

a seat carriage mounted on said rail;

a readout housing mounted on said rail;

a rowing arm pivotally mounted on the support frame at a pivot axis for stroking movement;

a microprocessor in said readout housing having a circuit including wiring extending from said readout housing via said rail and support frame to said second housing;

a chopper member extending from the rowing arm adjacent said pivot axis and presenting a series of light ports therethrough arranged to swing in an arcuate travel path having said pivot axis as its center of curvature responsive to stroking of the rowing arm;

a second housing mounted on said support frame beneath said pivot axis and having an upper opening into which said chopper member and light ports project; and a light emitter and receiver mounted in said second housing and connected to said wiring, said emitter and receiver being arranged in alignment at opposite sides of the chopper member to register with said light ports as they move ins aid travel path, whereby said circuit is alternately completed and interrupted responsive to various lengths of strokes of the rowing arm to thereby measure the length of travel and time duration of the strokes of the rowing arm.

2. An exercise rowing machine according to claim 1 in which a second light emitter and receiver are mounted beside the first-mentioned light emitter and receiver in said second housing to also register with said light ports as they move in said travel path, said second emitter and receiver also being connected to said wiring in said circuit.

3. An exercise rowing machine according to claim 1 in which load resisting means are pivotally connected to said rowing arm for yielding resisting movement of the rowing arm, said load resisting means having adjustment settings to vary the resistance to movement of the rowing arm without changing the location of the pivotal connection of the load resisting means to the rowing arm, and said microprocessor having an input for said adjustment settings and being programmed to calculate the work performed by stroking said rowing arm.

4. An exercise rowing machine according to claim 1 in which said second housing engages the underside of said support frame directly beneath said pivot axis and is secured to said second housing.

5. An exercise rowing machine comprising:

a support frame;

a rowing arm pivotally mounted on the support frame at a generally horizontal pivot axis for stroking movement, said rowing arm having a handle remote from said pivot axis;

means connected to the support frame and connected to the rowing arm between said handle and pivot axis for yieldingly resisting said stroking movement;

a chopper mounted on said rowing arm adjacent said pivot axis and projecting endwise of said rowing arm away from said handle, said chopper presenting a series of signal passing zones separated by signal interrupting zones arranged in an arcuate path having sad pivot axis as the center of curvature;

a housing mounted on said support frame directly beneath said pivot axis and providing an opening to receive said chopper;

said support frame including a generally horizontal frame member on which said rowing arm is pivotally mounted and said chopper projects into the opening of said housing;

an emitter and cooperating receiver in said housing and spaced apart by a gap aligned with said opening and arranged to have said chopper swing therethrough responsive to stroking of said rowing arm; and a readout circuit mounted on the support frame and including said emitter and receiver whereby said circuit measures the length of travel and time duration of the strokes of the rowing arm.

6. An exercise rowing machine according to claim 5 in which said readout circuit includes a microprocessor carried by the support frame and programmed to output the time duration of each stroke of said rowing arm.

7. An exercise rowing machine according to claim 5 in which said housing engages the underside of said frame directly beneath said pivot axis and has ground engagement.

* * * * *